US005517595A

United States Patent [19]

Kleijn

[11] Patent Number: 5,517,595

[45] Date of Patent: May 14, 1996

[54] DECOMPOSITION IN NOISE AND PERIODIC SIGNAL WAVEFORMS IN WAVEFORM INTERPOLATION

[75] Inventor: Willem B. Kleijn, Basking Ridge, N.J.

[73] Assignee: AT&T Corp., Murray Hill, N.J.

[21] Appl. No.: 195,221

[22] Filed: Feb. 8, 1994

[51] Int. Cl.[6] ..... G10L 9/00

[52] U.S. Cl. ..... 395/2.14; 395/2.2; 395/2.3

[58] Field of Search ..... 381/29–40; 395/2.1–2.4, 395/2.74, 2.73, 2.71

[56] References Cited

U.S. PATENT DOCUMENTS

| | | | |
|---|---|---|---|
| 4,910,781 | 3/1990 | Ketchum et al. | 395/2.32 |
| 5,119,423 | 6/1992 | Shiraki et al. | 395/2.28 |

OTHER PUBLICATIONS

Kleijn, "Speech Coding Below 4KB/S Using Waveform Interpolation", IEEE/IEE Pub., 1991 pp. 1879–1883.

Tang et al, "Variable Frame Length Prototype Waveform Interpolation for Low Bit Rate Speech Coding", IEE Colloq. 1993 No. 234, pp. 1–6.

Yang et al., "Voiced Speech Coding at Very Low Bit Rates Based on Forward–Backward Waveform Prediction (FBWP)", ICASSP '93, pp. 179–182.

S. Ono and K. Ozawa, "2.4KBPS Pitch Prediction Multi–Pulse Speech Coding, " *Proc. Int. Conf. ASSP,* 175–178 (1988).

S. Roucos and A. M. Wilgus, "High Quality Time–Scale Modification for Speech, "*Proc. Int. Conf. ASSP,* 493–496 (1985).

B. S. Atal and B. E. Caspers, "Beyond Multipulse and CELP Towards High Quality Speech at 4kb/s, " *Advances in Speech Coding,* 191–201 (1991).

W. B. Kleijn, D. J. Krasinski and R. H. Ketchum, "Improved Speech Quality and Efficient Vector Quantization in SELP," *Proc. Int. Conf. ASSP,* 155–158 (1988).

F. J. Charpentier and M. G. Stella, "Diphone Synthesis Using an Overlap–Add Technique for Speech Waveforms Concatenation," *Proc. Int. Conf. ASSP,* 2015–2018 (1986).

W. B. Kleijn, "Encoding Speech Using Prototype Waveforms," *IEEE Trans. Speech and Audio Processing,* vol. 1, No. 4, pp. 386–399 (1993).

Burnett and Holbech, "A Mixed Prototype Waveform/CELP Coder for Sub 3Kb/s", *Proceedings ICASSP, pp. II175–II178 (1993).*

Kabal and Leong, "Smooth Speech Reconstruction Using Prototype Waveform Interpolation", *Proc. IEEE Workshop on speech Coding for Telecommunications,* pp. 39–41 (1993).

Kleijn and McCree, "Mixed–Excitation Prototype Waveform Interpolation, " *Proc. IEEE Workshop on Speech Coding for Telecommunications,* pp. 51–52 (1993).

*Primary Examiner*—Allen R. MacDonald
*Assistant Examiner*—Michelle Doerrler
*Attorney, Agent, or Firm*—Thomas A. Restaino; R. D. Slusky

[57] ABSTRACT

A method of coding a speech signal is described. In accordance with the method, a plurality of sets of indexed parameters are generated based on samples of the speech signal. Each set of indexed parameters corresponds to a waveform characterizing the speech signal at a discrete point in time. Parameters of the plurality of sets are grouped based on index value to form a first set of signals which represents the evolution of characterizing waveform shape; the signals of the first set are filtered to remove low frequency components and thereby produce a second set of signals which represents relatively high rates of evolution of characterizing waveform shape. The speech signal is then coded based on the second set of signals representing high rates of characterizing waveform shape evolution. Coding of the speech signal may further be based on a set of smoothed first signals.

20 Claims, 7 Drawing Sheets

DECOMPOSITION IN NOISE AND PERIODIC SIGNAL WAVEFORMS IN WAVEFORM INTERPOLATION

CROSS-REFERENCE TO RELATED APPLICATION

This application is related to commonly assigned U.S. patent application Ser. No. 08/179,831, filed Jan. 5, 1994 which is a continuation of Ser. No. 07/866,761, filed Apr. 9, 1992, now abandoned which applications are incorporated by reference as if fully set forth herein.

FIELD OF THE INVENTION

The present invention is related generally to speech coding systems and more specifically to speech coding systems using waveform interpolation.

BACKGROUND OF THE INVENTION

Speech coding systems function to provide codeword representations of speech signals for communication over a channel or network to one or more system receivers. Each system receiver reconstructs speech signals from received codewords. The amount of codeword information communicated by a system in a given time period defines the system bandwidth and affects the quality of the speech received by system receivers.

The objective for speech coding systems is to provide the best wade-off between speech quality and bandwidth, given side conditions such as the input signal quality, channel quality, bandwidth limitations, and cost. The speech signal is represented by a set of parameters which are quantized for transmission. Perhaps most important in the design of a speech coder is the search for a good set of parameters (including vectors) to describe the speech signal. A good set of parameters requires a low system bandwidth for the reconstruction of a perceptually accurate speech signal. The bandwidth required for each parameter is a function of the rate at which it changes, as well as the accuracy it needs for high quality reconstructed speech.

The human auditory system is very sensitive to the level of periodicity of the reconstructed signal. The level of periodicity is a function of both time and frequency. Speech varies in the level of periodicity. Voiced speech is characterized by a high level of periodicity, and unvoiced speech has a low level of periodicity. Coders operating at lower bit rates generally do not reconstruct the level of periodicity in a perceptually transparent fashion.

From information-theoretic arguments, it can be shown that the signal bandwidth required to transmit the waveform of a noisy signal exactly is very high. However, for perceptually accurate signal reconstruction, only certain statistical quantities of the noise component of a signal require transmission (mainly a rough description of its magnitude spectrum). This makes the separation of the periodic and noisy components of the original signal unavoidable for efficient coding at low bit rates.

The first-generation linear-prediction based vocoders generally used a simple 2-state periodicity description (periodic or nonperiodic), uniform over the entire signal frequency band and updated about once every 25 ms. See, e.g., Tremain, "The Government Standard Linear Predictive Coding Algorithm", *Speech Technology,* pp. 40–49 (April 1982). Some of the more recent coders use a frequency-dependent periodicity level (usually with 2 levels per band).

Others use multiple coding modes, each of which can generally be associated with a particular mean level of periodicity. In general, it is difficult to assess the level of periodicity reliably with existing methods. In addition, the time-resolution of the periodicity level is low.

In recent years, it has been shown that the prototype-waveform interpolation (PWI) method provides an efficient method for the coding of voiced speech. The basic concept of PWI is to extract a representative pitch cycle (the prototype waveform) at fixed intervals, to transmit its description, and to reconstruct the speech signal by interpolating between the prototype waveforms. In most implementations the PWI method operates on the linear-prediction residual signal, and the prototype waveforms are described with a Fourier-series. W. B. Kleijn, "Encoding Speech Using Prototype Waveforms," *IEEE Trans. Speech and Audio Processing,* Vol. 1, No. 4, p. 386–399 (1993).

In existing implementations of the PWI coding method, the nonperiodic signal is coded by another method of speech coding, usually CELP. The switching between coders is inherently unrobust. Usually, the CELP has no pitch predictor because of the low bit rates at which the system is operating. Thus, the level of periodicity can vary only within a small range in both the PWI and CELP modes. The performance of the PWI coding can be improved upon by adding spectrally-shaped noise to the PWI-synthesized signal, or by increasing the update rate of the prototype waveforms (increasing the signal bandwidth). In practice, existing implementations of the PWI coding method suffer from artifacts introduced by incorrect representation of the periodicity levels.

SUMMARY OF THE INVENTION

The present invention provides a speech-coding method and apparatus. An illustrative embodiment of the speech coder comprises an outer layer and an inner layer. The outer layer is a prototype-waveform-interpolation analysis-synthesis system. Its analysis part computes the linear-prediction residual, performs pitch detection, and extracts the prototype waveforms. The synthesis part of the outer layer aligns the prototype waveforms, interpolates in time between the aligned prototype waveforms to create instantaneous waveforms, reconstructs the residual (excitation) signal by concatenation of samples taken from successive instantaneous waveforms, and filters the excitation signal with the linear-prediction synthesis filter. At high sampling rates (less than one half pitch cycle per prototype waveform), this outer layer analysis-synthesis system renders reconstructed speech which is virtually transparent.

The inner layer of the illustrative speech coder quantizes the prototype waveforms. First, the prototype waveforms are processed with a smoothing window. This results in a smoothly evolving waveform (SEW) associated with each prototype waveform. The SEW is then subtracted from the original prototype waveform, to render a remainder, which will be called the rapidly evolving waveform (REW). The SEW and the REW are quantized independently. At low bit rates, the SEW can be replaced by waveform with a flat magnitude spectrum and a fixed phase spectrum. The SEW phase spectrum may be quantized with small set of possible states, and the SEW magnitude spectrum may be quantized differentially. At yet higher bit rates the SEW can be quantized differentially. For the REW, only the magnitude spectrum carries perceptually significant information. This magnitude spectrum can be quantized as a ratio of the overall magnitude spectrum of the prototype waveform. These ratios effectively describe the periodicity levels as a function of frequency. The quantized descriptions of the REW and SEW (if appropriate) are transmitted to the systems receiver.

The REW is reconstructed by combining the known magnitude spectrum with a random phase or by multiplying this known magnitude spectrum with a spectrum representing Gaussian noise. The SEW is reconstructed using quantization tables. The prototype waveforms are obtained by addition of the SEW and the REW, completing the inner layer of the speech coder.

A subset of operations which are necessary to obtain the periodicity-levels form a periodicity-level detector. This periodicity detector provides decisions with a high time and low frequency resolution, and it can be used in combination with other speech coding algorithms.

The illustrative embodiment of the present invention operates on the residual signal of an adaptive linear predictor, but it can also operate on other signals representing the speech including the speech signal itself.

DETAILED DESCRIPTION

Introduction

The present invention concerns a method of coding speech using waveforms which serve to characterize the speech signal to be coded. These waveforms are referred to as characterizing waveforms. A characterizing waveform is a signal of a length which is at least one pitch-period, where the pitch-period is defined to be output of a pitch detection process. (Note that a pitch detection process always supplies a pitch-period even for speech signals without obvious periodicity; for unvoiced speech, such a pitch-period is essentially arbitrary.) An illustrative characterizing waveform is formed based on the output of a linear predictive (LP) filter which operates on original speech (to be coded). This output is referred to as the LP residual.

Figure 1:
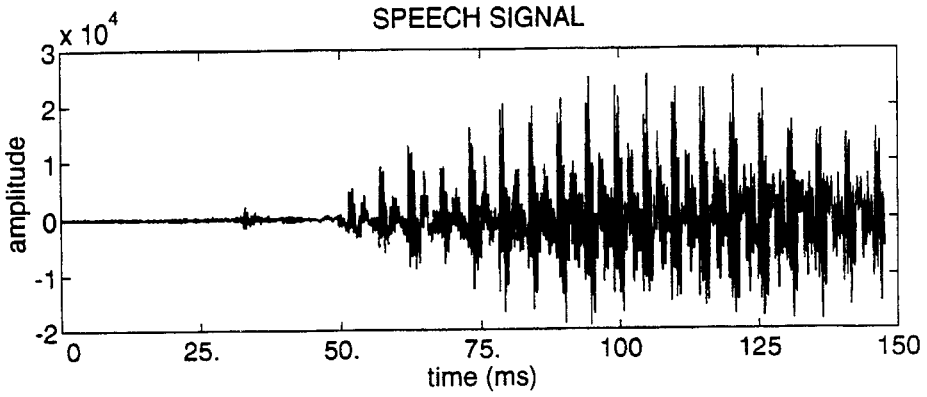
FIG. 1 presents a segment of a speech signal including voiced and unvoiced subsegments.

FIG. 1 presents an illustrative segment of a speech signal to be coded in accordance with the present invention. As seen in the Figure, this segment comprises subsegments of unvoiced speech (approximately the first 50 ms) and voiced speech (the balance of the segment). As is conventional in speech coding, this original speech signal is passed through an LP filter to remove short-term correlations in the speech signal. This filtering enhances the coding process.

Figure 2:
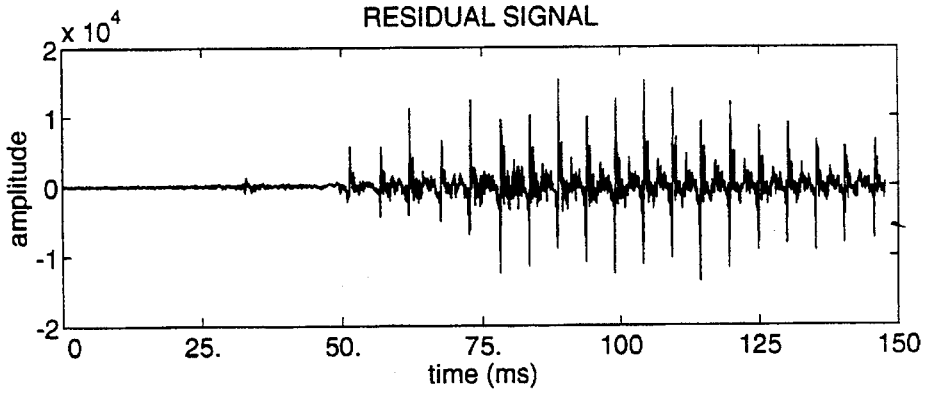
FIG. 2 presents a linear prediction residual of the speech signal of FIG. 1.

When the speech signal shown in FIG. 1 is passed through an LP filter, a residual speech signal is formed. This residual signal is shown in FIG. 2. The magnitude of the residual signal is decreased as a result of LP filtering. Moreover, with short-term correlations removed, the residual signal clearly displays long-term correlation features of the original speech signal.

Because of its quasi-periodic nature, the residual speech signal (and the original speech signal, for that matter) can be described efficiently with a Fourier-series having time-varying coefficients to account for the fact that the signal is not exactly periodic. Thus, the residual signal of FIG. 2 may be described by the following Fourier-series:

$$r(n) = \sum_{i=0}^{K} a_i(n)\cos(\omega_o i\, n) + b_i(n)\sin(\omega_o i\, n) \tag{1}$$

where $\omega_o$ is the fundamental frequency. This Fourier-series may be evaluated at various discrete moments in time, $t_1$, $t_2$, $t_3$ . . . , as follows:

$$r(t_1) = \sum_{i=0}^{K} a_1(t_i)\cos(\omega_o i\, t_1) + b_{t_1}(t_i)\sin(\omega_o i\, t_1) \tag{2}$$

$$r(t_2) = \sum_{i=0}^{K} a_1(t_i)\cos(\omega_o i\, t_2) + b_i(t_i)\sin(\omega_o i\, t_2) \tag{3}$$

$$r(t_n) = \sum_{i=0}^{K} a_1(t_n)\cos(\omega_o i\, t_n) + b_i(t_n)\sin(\omega_o i\, t_n) \tag{4}$$

Note that each of these individual Fourier-series has coefficients evaluated at a particular moment in time (a discrete moment in time). The set of Fourier coefficients (or parameters) for a given series are indexed by an index i. Such individual Fourier-series may be viewed as giving rise to individual periodic functions of a variable $\tau$. These individual periodic functions are waveforms which characterize the residual signal at given moments in time. These functions are the characterizing waveforms. Each characteristic waveform is therefore described by a finite set of indexed parameters—here, the Fourier-series coefficients.

Figure 3:
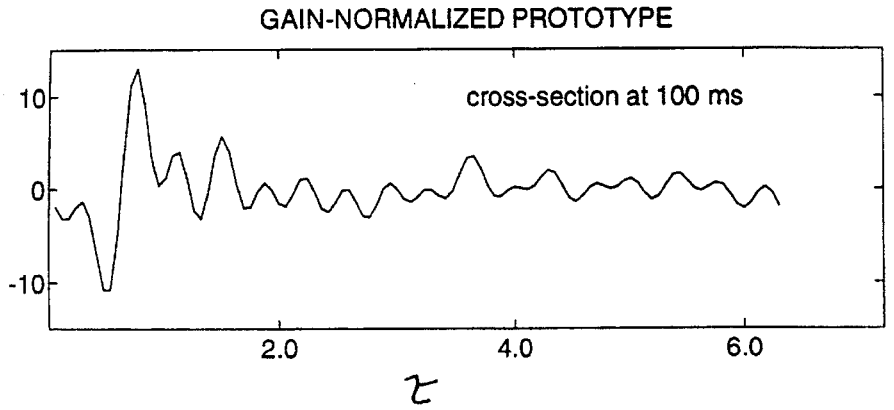
FIG. 3 presents a characterizing waveform of the residual signal of FIG. 2.

An example of such a characterizing waveform is shown in FIG. 3. This particular example corresponds to time t=100 ms of the residual speech signal. The coefficients of the Fourier-series are generated by a Fourier transform of a segment of the residual speech signal. In computing this Fourier transform, a segment of the residual speech signal is used which is centered at or near the discrete time of interest (in this example, t=100 ms). This residual signal segment extends for at least one-half pitch-period in either direction.

In the literature, characterizing waveforms of substantially one pitch period are termed prototype waveforms. See, e.g., Burnett and Holbech, "A Mixed Prototype Waveform/CELP Coder for Sub 3 kb/s", *Proceedings ICASSP*, pp. II175– II178 (1993); Kabal and Leong, "Smooth Speech Reconstruction Using Prototype Waveform Interpolation", *Proc. IEEE Workshop on speech Coding for Telecommunications*, pp. 39–41 (1993); Kleijn and McCree, "Mixed-Excitation Prototype Waveform Interpolation," *Proc. IEEE Workshop on Speech Coding for Telecommunications*, pp. 51–52 (1993). For purposes of clarity of explanation, the balance of this introduction and the description of the illustrative embodiments which follows will concern prototype waveforms.

Naturally, a characterizing waveform must describe at least one complete pitch cycle of voiced speech. Waveform interpolation coders generally include alignment processes for sequential characterizing waveforms. In the illustrative coding embodiment discussed below, this alignment is performed after the time-scale normalization of the pitch-cycle waveform to have unit pitch period. The time-scale normalization is uniform over the pitch cycle. During voiced speech, the alignment of the single pitch cycle essentially aligns the (single) pitch pulses of the characterizing waveforms. If the characterizing waveform were to describe more than one pitch cycle, multiple pitch pulses can appear in each waveform, and their simultaneous alignment is often problematic when using uniform time-scaling. This is the result of a changing pitch-period. Using time-warping as well as time scaling may be one method to resolve such alignment difficulties. Because of such practical issues, the characterizing waveforms normally correspond to one pitch cycle (i.e., a prototype waveform) during voiced speech. However, it will be apparent to those of ordinary skill in the art that the present invention is applicable to characterizing waveforms generally.

Figure 4:
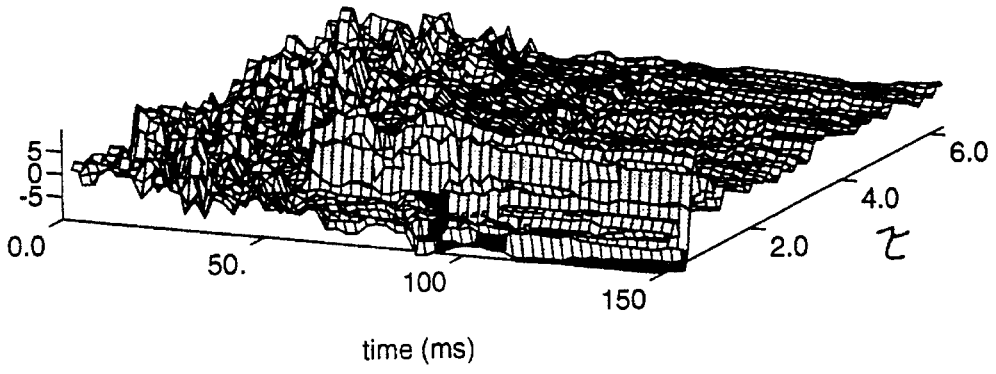
FIG. 4 presents a surface comprising a series of contiguous characterizing waveforms of the residual signal of FIG. 2.

As discussed above, each of the Fourier-series representing a prototype waveform may be thought of as a periodic function of a variable $\tau$. Assume that Fourier-series coefficients are evaluated every 2.5 ms. Therefore, there is a prototype waveform extending orthogonally to the time axis every 2.5 ms. If each of these prototype waveforms is plotted on axis $\tau$ which is orthogonal to the time axis, a prototype waveform "surface" is created. This surface is shown in FIG. 4. A cross-section of this surface at any 2.5 ms point in time is an individual prototype waveform. For example, FIG. 3 presents the prototype waveform which corresponds to the cross-section of this surface at t=100 ms. As may be seen in both FIGS. 3 and 4, the prototype waveform at t=100 ms exhibits a pitch-pulse for $0 \leqq \tau \leqq 1$ rad.

When viewed down the time axis, the sequence of prototype waveforms for a given value of $\tau$ forms a signal which represents the evolution of the prototype waveform at waveform time $\tau$ over time t. Thus, the surface of FIG. 4 represents the evolution of prototype waveform shape. The surface may thus be thought of as comprising a series of contiguous prototype waveforms or a series of contiguous signals (which run orthogonally to the prototype waveforms).

If each prototype waveform is expressed as a Fourier-series, then each Fourier-series coefficient of index i is a function of time. The set of Fourier-series coefficient functions describe the evolution of the prototype waveform.

Figure 6:
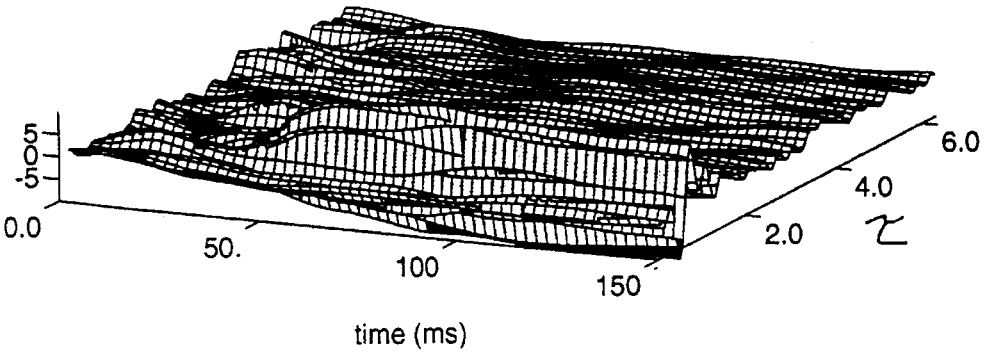
FIG. 6 presents a surface comprising a series of contiguous smoothly evolving characterizing waveforms.
Figure 8:
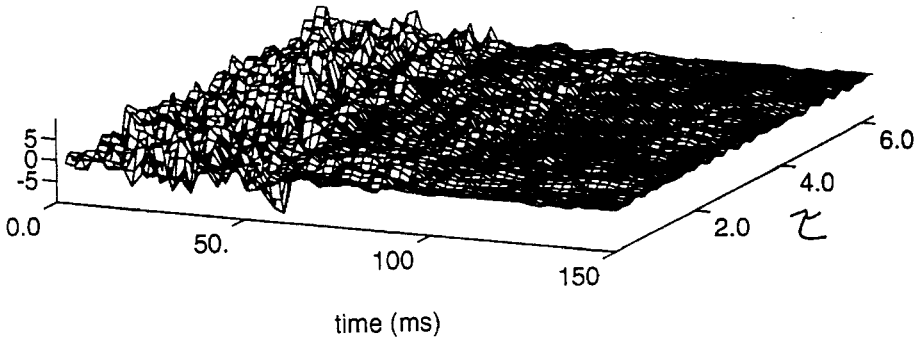
FIG. 8 presents a surface comprising a series of rapidly evolving characterizing waveforms.

The evolution of prototype waveform shape (as shown illustratively in the surface of FIG. 4) may be thought of as comprising low frequency and high frequency prototype waveform shape evolution. Illustratively, such low and high frequency prototype waveform shape evolution may be pictured as two surfaces, such as those presented in FIGS. 6 and 8, respectively. FIGS. 6 and 8 present illustrative low and high frequency waveform shape evolution surfaces, respectively, which sum to the surface of FIG. 4. The significance to the present invention of low and high frequency waveform shape evolution lies in the ear's ability to distinguish between slow and rapid evolution. Slowly evolving waveforms essentially describe the periodic component of the speech signal, and rapidly evolving waveforms essentially describe the noise component of the speech signal. In accordance with information theory, the ear's ability to perceive information in the noise component of speech is low. As a result, such component may be quantized differently than the periodic component.

Figure 5:
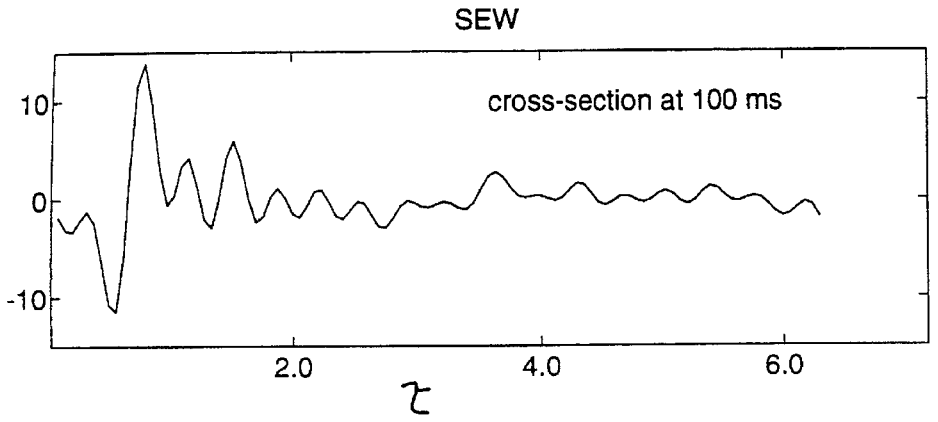
FIG. 5 presents a smoothly evolving characterizing waveform.
Figure 7:
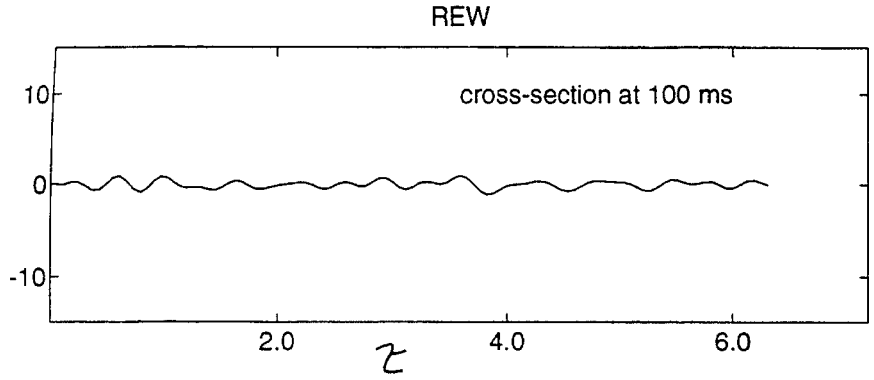
FIG. 7 presents a rapidly evolving characterizing waveform.

Each prototype waveform at discrete point in time (such as that presented in FIG. 3) has associated with it waveforms of the smoothly and rapidly evolving surfaces. Illustrative smoothly and rapidly evolving waveforms are shown at FIGS. 5 and 7, respectively. These waveforms represent a cross-section of the smoothly and rapidly evolving surfaces, respectively, at t=100.

In accordance with the present invention, slowly and rapidly evolving waveforms are determined for use in coding speech. Given the ear's differing sensitivity to such waveforms, an illustrative coding method in accordance with the present invention codes information about a smoothly evolving waveform more accurately than information about a corresponding rapidly evolving waveform.

An illustrative coder forms smoothly and rapidly evolving waveforms every 2.5 ms. The smoothly evolving waveform at a given point in time is formed by a smoothing process which uses as input a set of prototype waveforms falling within a time window centered at or about the point in time at which the smoothly evolving waveform is desired. This set of prototype waveforms corresponds to a portion of the surface presented in FIG. 4, the portion defined by the window. Prototype waveform parameters of like-index (such as Fourier-series coefficients) are grouped and averaged. This is done for each parameter index value. The result is a set of averaged parameters which correspond to a smoothly evolving waveform at the point in time of interest. This waveform is the smoothly evolving waveform (SEW), such as that shown in FIG. 5. The rapidly evolving waveform (REW) is determined by subtracting the SEW from the prototype waveform (through the subtraction of corresponding parameter values). The SEW and REW are then available for use in coding. In one embodiment of the present invention, only the REW need be quantized. In other embodiments, both the REW and SEW are quantized (with different techniques to reflect human hearing sensitivity to such waveforms). These embodiments are discussed in detail below.

Illustrative Embodiment Hardware

For clarity of explanation, the illustrative embodiments of the present invention are presented as comprising individual functional blocks (including functional blocks labeled as "processors"). The functions these blocks represent may be provided through the use of either shared or dedicated hardware, including, but not limited to, hardware capable of executing software. For example, the functions of processors presented in FIGS. 13 and 15 may be provided by a single shared processor. (Use of the term "processor" should not be construed to refer exclusively to hardware capable of executing software.)

Illustrative embodiments may comprise digital signal processor (DSP) hardware, such as the AT&T DSP16 or DSP32C, read-only memory (ROM) for storing software performing the operations discussed below, and random access memory (RAM) for storing DSP results. Very large scale integration (VLSI) hardware embodiments, as well as custom VLSI circuitry in combination with a general purpose DSP circuit, may also be provided.

The Illustrative Embodiments

Figure 9:
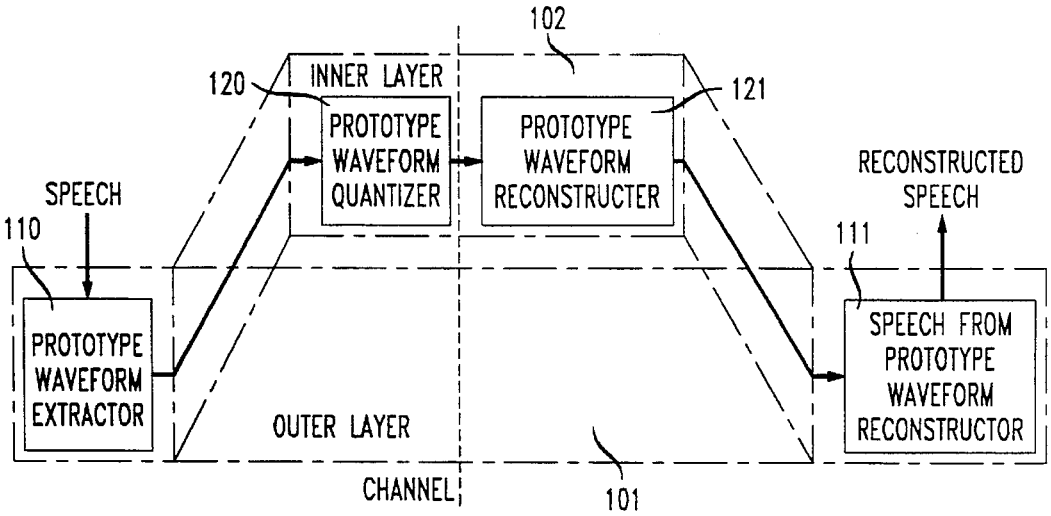
FIG. 9 shows a block diagram of a basic coder-decoder system in accordance with the present invention.

An illustrative speech coder according to the present invention comprises an outer layer and an inner layer, as is shown in FIG. 9. The outer layer 101 contains the prototype extractor 110 and the speech-from-prototype-waveform reconstructor 111. The original and reconstructed speech is in a sampled, digital format, typically sampled at 8000 Hz. The inner layer 102 contains the prototype waveform quantizer 120 and the prototype waveform reconstructor 121. When the inner layer is omitted, the outer layer 101 forms an analysis-synthesis system which reconstructs speech which is perceptually transparent, or nearly so. In general, the outer layer performs perceptually accurate reconstruction for all signals which can be classified as periodic, noisy, or a combination of these two. The outer layer will do less well on signals with a more complex fine structure of the power spectrum such as music, in these cases the reconstructed signal gracefully converges to a signal with the correct spectral envelope, but with no fine structure. (In contrast to many low-bit-rate coders, the fine structure does not switch in an annoying fashion between periodic and nonperiodic.)

Outer Layer: Prototype-Waveform Extractor

Figure 10:
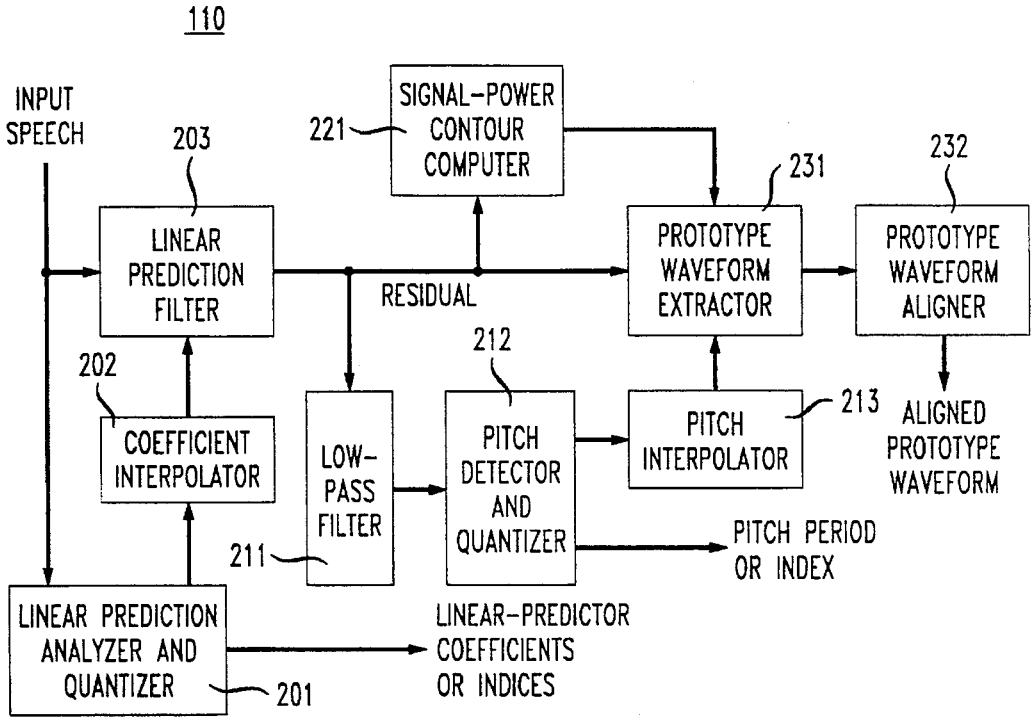
FIG. 10 shows a block diagram of a prototype waveform extractor of the outer layer shown in FIG. 9.

FIG. 10 presents a block diagram of the illustrative prototype waveform extractor 110 of the outer layer. First the linear-prediction (LP) coefficients are computed (using well-known methods such as the Durbin or Schur recursions) and quantized in 201. The operation is performed at a fixed rate, typically once every 20–30 ms. The LP coefficients are then interpolated on a block-by-block basis as is conventional (a block usually being about 5 ms). The interpolation is generally performed in a transform domain (e.g. the line-spectral frequency domain). The input speech signal is then filtered with conventional LP filter 203 to render the residual signal. The residual signal is characterized by a power spectrum which has an envelope which is significantly flatter than that of the original speech signal.

A low-pass filter 211 is used to obtain a low-pass filtered version of the residual signal for pitch detection. The pitch detector 212 uses a weighted autocorrelation function criterion to select the pitch period proper for a certain point in time. The pitch-detection method includes a 20–30 ms delay prior to the final decision. During this delay, the pitch period can be corrected, using information on the reliability of the present and future pitch detections. This is particularly useful for voicing onsets, where a reliable pitch detection is only possible by looking further ahead into the voiced region. The inverse of the pitch period (the fundamental frequency) is then linearly interpolated over time in interpolator 213. Other interpolation procedures, e.g. linear interpolation of the pitch period, provide similar output speech quality, but generally require more computational effort. (The interpolated fundamental frequency is required at each sample during synthesis.)

Processor 221 computes the contour of the signal power, by first squaring the samples and then applying a window of approximately 4 samples in length (for a 8000 Hz sampling rate). In some implementations, processor 221 operates on a low-pass filtered version of the residual signal. The purpose of the window is to show the variation in signal power within each pitch cycle, such that pitch pulses, if present, are clearly visible.

Processor 231 performs the actual prototype waveform extraction. A prototype waveform is extracted from the residual signal at regular time intervals. However, for proper operation of the outer layer, it is essential that high-power signal segments (e.g. the pitch pulses) are not located on the boundary of the extracted prototype waveform. This is because in the waveform-interpolation paradigm, the prototype waveform is considered to be one cycle of a periodic signal, which is representative of the speech signal at the moment of extraction. An incorrect choice of the boundary can lead to large discontinuities in this periodic signal, and these discontinuities are not representative of the speech waveform, but rather an artifact of the extraction. To prevent such discontinuities, the prototype waveform is selected as a segment of residual signal, with 1) its center located near the extraction time point, 2) length one pitch period (as obtained from processor 213), and 3) low signal power (as obtained by processor 221) near its boundaries. The prototype-waveform extractor operates by computing the signal power near the boundaries of a plurality of signal segments of length one pitch period which are centered within 15 samples (at 8000 Hz sampling rate), and selecting the segment with the lowest signal power near the boundaries as the prototype waveform. Other techniques for extracting prototype waveforms are described in the commonly assigned U.S. Patent Applications referenced above.

Upon the receipt the prototype waveform by the prototype-waveform aligner 232, the prototype waveform is aligned with the previous prototype waveform. This alignment implies that the time-domain features of these two waveforms, time-scaled to unit length, are maximally aligned. If both prototype waveforms are described by Fourier-series coefficients, this is accomplished by precessing the phase of the present prototype waveform until the cross-correlation between the periodic signals associated with the present and previous prototype waveform are maximized. This procedure is described by equation (24) in: W. B. Kleijn, "Encoding Speech Using Prototype Waveforms" *IEEE Trans. Speech and Audio Processing,* Vol. 1, No. 4, p. 386–399, 1993.

The alignment procedure can be enhanced by a special feature. Instead of searching for all possible phase precessions, only a small range of phase precessions is allowed (e.g. $0.1 * 2\pi$). The center of this range is obtained from the expected value of the precession. As compared to the previous prototype waveform, the present prototype waveform is expected to precess by $2\pi D/p$ from the previous prototype waveform, where D is the time distance between their centers of extraction, and p is the pitch period. This small amount of allowed precession means that, the prototype waveforms are properly aligned during highly periodic signal segments but nonperiodic features are generally not aligned for maximum correlation. This reduces the amount of periodicity generated for an original signal which was not periodic.

Outer Layer: Speech-From-Prototype-Waveform Reconstructor

Figure 11:
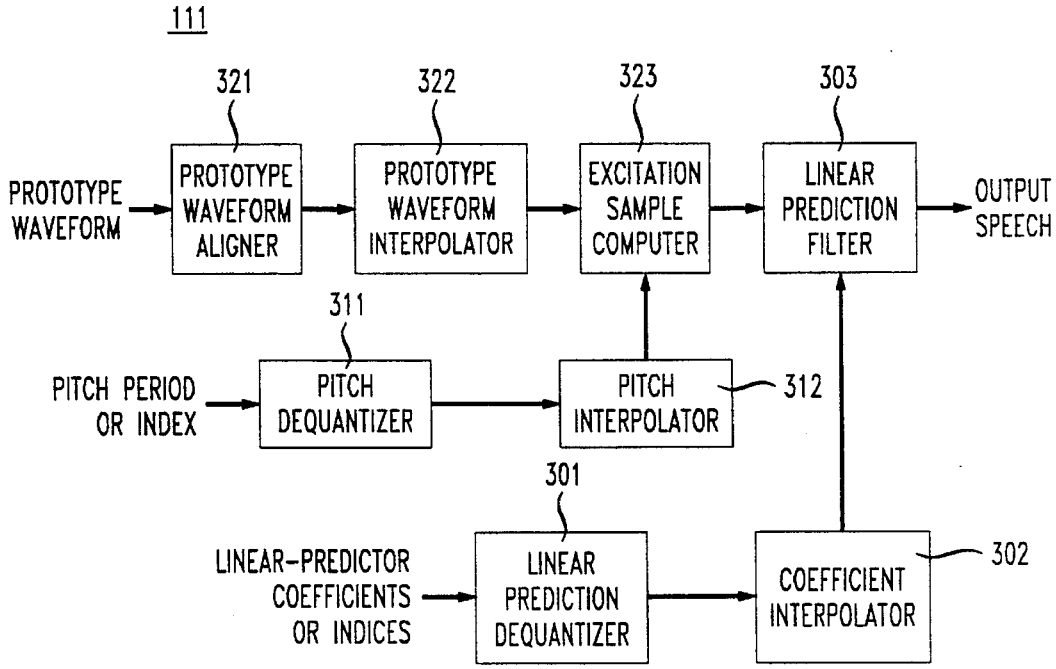
FIG. 11 shows a block diagram of a speech-from-prototype waveform reconstructor of the outer layer of FIG. 9.

FIG. 11 shows more details of the illustrative speech-from-prototype-waveforms reconstructor 111 of the outer layer. Processor 301 obtains the prediction coefficients from their quantization indices (301 is inactive if the unquantized LP coefficients are used in the synthesis process). Processor 302 interpolates the LP coefficients in exactly the same manner as processor 202 of FIG. 10. Processor 311 dequantizes the pitch period (if it is quantized); it is inactive if the quantized pitch period is provided to reconstructor 111. Interpolator 312 performs the same interpolation as processor 213 of FIG. 10. Alignment processor 321 is identical to alignment processor 232 of FIG. 10. Obviously, processor 321 can be omitted if the prototype waveforms arrive at the speech-from-prototype-waveforms reconstructor 111 straight from prototype-waveform-extractor 110.

Prototype waveform interpolator 322 interpolates the prototype waveform shapes (the shape interpolation can be performed with a normalized pitch period). Interpolator 322 generates an instantaneous waveform for each sample of the output speech signal. Excitation-sample computer 323 obtains an appropriate sample from the instantaneous waveform. Each sample is precessed from the previous sample by $2\pi T/p$, where T is the sample interval, and p is the current pitch period. Let $f(\tau,t)$ describe the instantaneous waveform at time t, which is a periodic function of $\tau$. $f(t,\tau)$ is normalized in $\tau$ to have a pitch period of $2\pi$. Let $f(\tau_0,t_0)$ denote the residual sample at time $t_0$. Then the output at time $t_0+T$ is $f(\tau_0+2\pi T/p,t_0)$. (Because of periodicity, any multiple of $2\pi$ can be subtracted from $\tau$.) The resulting excitation signal is filtered by the LP synthesis filter 303. Interpolation and sample computation have been described in detail in the above-referenced U.S. Patent Applications.

Outer Layer: Performance Issues

The performance of the analysis-synthesis system described by the outer layer of FIG. 1 depends strongly on the update rate of the prototype waveforms. FIG. 4*a* shows a typical excitation signal. Consider the case of linear interpolation. If the updates are time instants a and a+T, then the instantaneous waveforms within the time interval [a,a+T] are computed from the prototype waveforms $f(\tau,a)$ and $f(\tau,a+T)$ using:

$$f(\tau,t)=\frac{a+T-t}{T}f(\tau,a)+\frac{t-a}{T}f(\tau,a+T). \quad (5)$$

Note that the effect of any particular prototype waveform extends over a range of T into the past and a range T into the future. This range affects the ability of the synthesis system to reproduce periodic and nonperiodic signals. This is illustrated in FIG. 12.

Figure 12A:
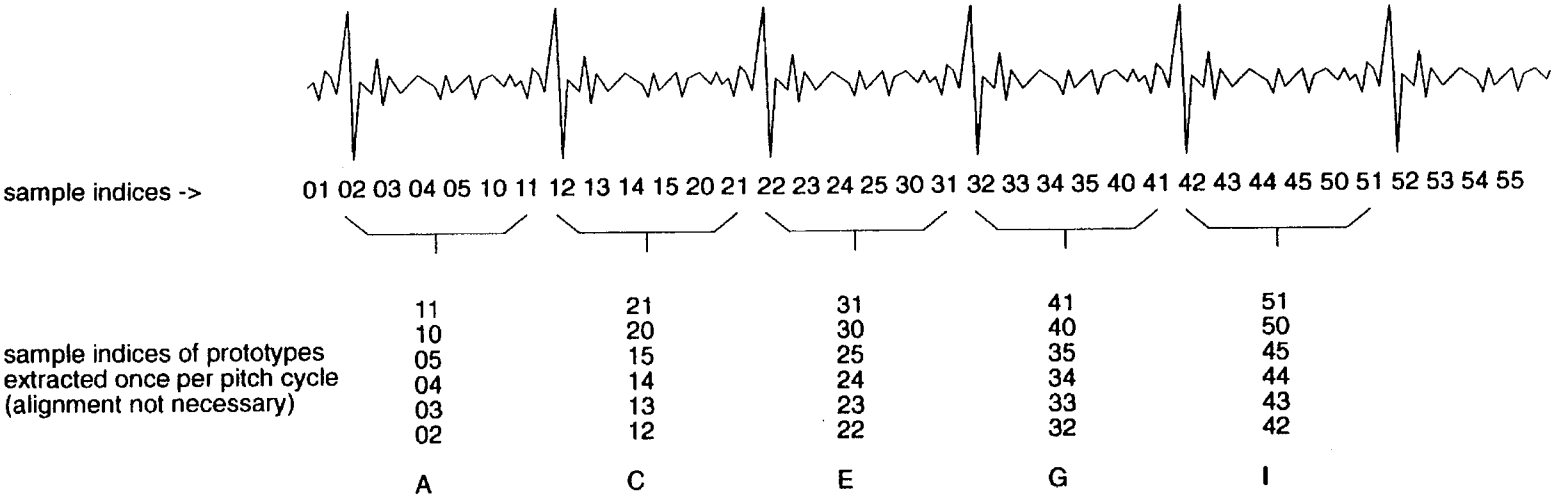
FIGS. 12*a* and 12*b* present illustrative prototype extraction techniques.

FIG. 12*a* shows the sample indices of a signal which is some mixture of a periodic signal (having a period of 6 samples) and a noise signal. The periodic component of the signal is shown in the sample indices, where the first digit is the pitch-cycle index, and the second digit is the sample index within that cycle. Thus sample 23 is the third sample of the second pitch cycle. The prototype waveforms are extracted exactly once per pitch cycle. The samples of the prototype waveform are shown along the vertical ($\tau$) axis, and each prototype waveform is labeled by capital letter. This extraction is performed between samples 4 and 5 of each pitch cycle (extraction at a noninteger sample time was chosen for illustration purposes only; it allows a proper relation between FIG. 12*a* and FIG. 12*b*). Now consider the instantaneous waveforms at sample index 13 and 23, i.e. two samples at a separation of exactly one pitch period. The instantaneous waveform at sample index 13 is dependent on prototype waveform A and prototype waveform C, while the instantaneous prototype waveform at sample index 23 depends on prototypes C and E. Both these instantaneous waveforms are dependent on prototype waveform C. This means that there will be a correlation between the instantaneous waveforms at sample index 13 and 23. Such correlation results periodicity of the reconstructed signal. This is not appropriate for the reconstruction of signals with a low level of periodicity.

Figure 12B:
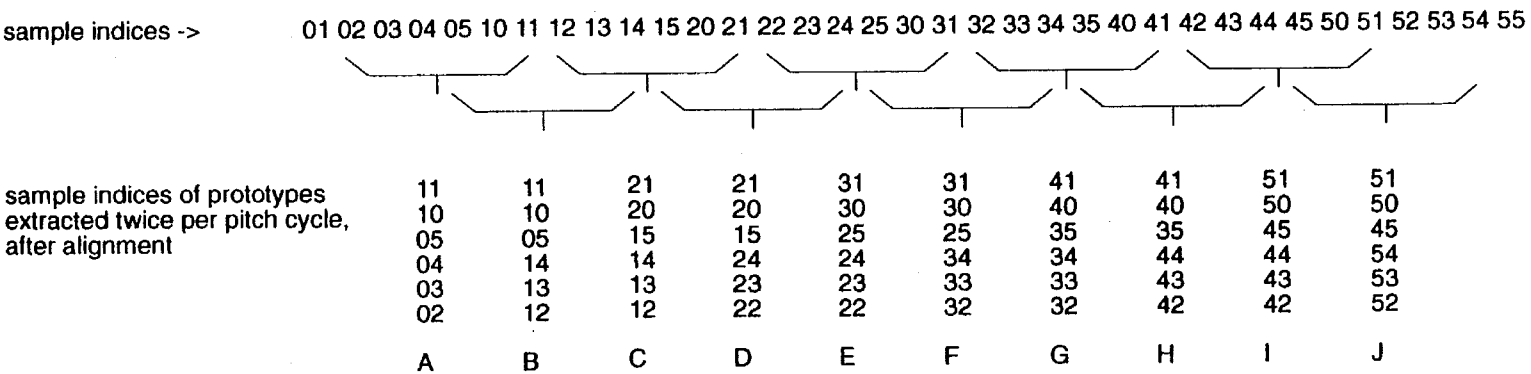

The problem of increased periodicity diminishes with increasing update rate of extraction of the prototype waveforms. This is illustrated in FIG. 12*b*. Again consider the instantaneous waveforms at sample index 13 and 23. The instantaneous waveform at sample index 13 depends on prototype waveforms B and C, and the instantaneous waveform at sample index 23 depends on prototypes waveforms D and E. However, the instantaneous waveforms are not entirely independent. Prototype waveforms C and D share 3 of their 6 samples. Thus, the unwanted correlation of the between the instantaneous waveforms is significantly reduced by the increased update rate, but does not vanish entirely. Note that even such a small segment of correlated samples can give rise to segments of excitation signal with the same correlation as would have been obtained without the higher update rate, but that the average correlation decreases. The higher the update rate of the prototype waveform the more accurate the reconstruction of the original level of periodicity. However, it should be understood that even in the limit of one update per signal sample and exact pitch tracking, the original signal will generally not be reconstructed exactly. Such a system does provide a very high level of perceptual accuracy, however. To prevent the large computational effort associated with such a system, it is useful to know the update rate required for perceptually transparent analysis-synthesis of speech signals and common background noise. Experimental evidence has shown that an update rate which is at least twice the fundamental frequency of the signal suffices for this purpose. An update rate of about 500 Hz can be used for most speech. The outer layer may be obtained by employing the prototype waveform extraction and speech reconstruction procedures of the speech coder of the above-referenced Patent Applications run at the 500 Hz update rate.

The discussion of the update rate focused mainly at the synthesizer. In principle, transmission of one prototype waveform per pitch cycle suffices to create a sequence of prototype waveforms with higher update rate. In practice, it is most convenient to run the analyzer also at the higher rate.

Inner Layer

As is shown in FIG. 9, the inner layer of the coder 102 contains the quantization and reconstruction of the prototype waveforms. The communications channel is situated between these two functions, which are shown in more detail in FIGS. 13 and 14, respectively. As discussed in the above-referenced U.S. Patent Application, the prototype waveforms can be represented in the form of a Fourier-series. Thus, each prototype waveform is described by a set of Fourier-series coefficients, consisting of two real numbers for each harmonic, or, equivalently, one complex number for each harmonic. The set of complex Fourier coefficients form the complex Fourier spectrum of the prototype waveform. A complex Fourier spectrum can be separated into a phase spectrum and a magnitude spectrum by writing each complex Fourier coefficient in polar coordinates.

Inner Layer: Gain Quantization

Figure 13:
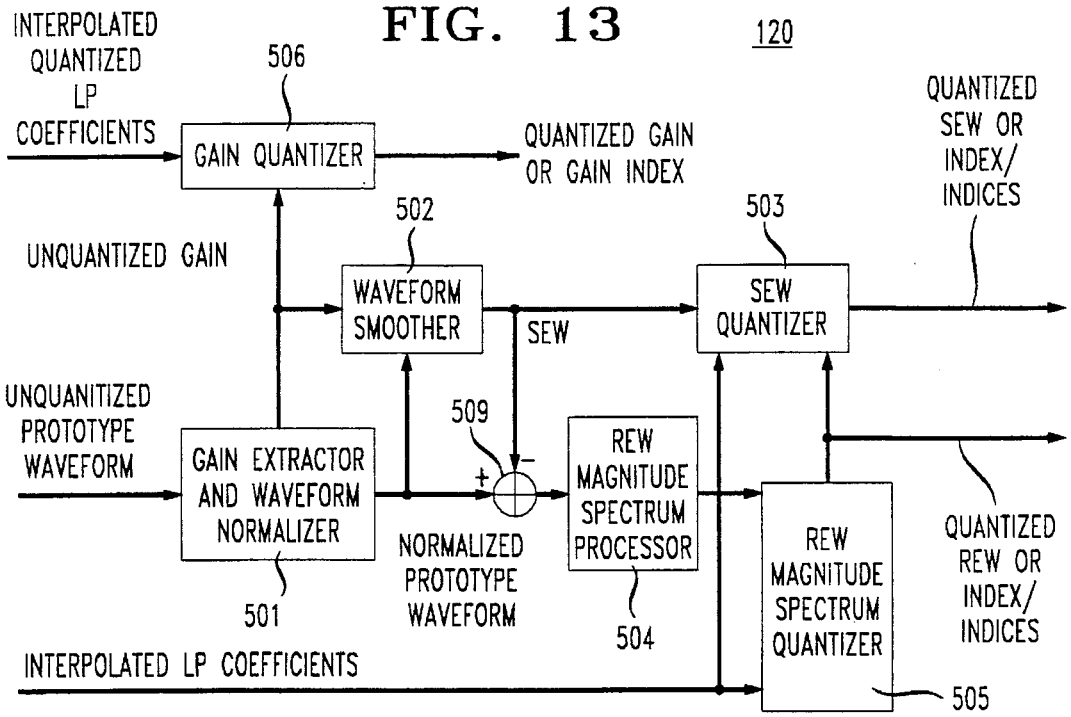
FIG. 13 presents a prototype waveform quantizer of the inner layer shown in FIG. 9.

A prototype waveform quantizer is illustrated in the block diagram of FIG. 13. The first step of the quantization process is the determination and quantization of prototype gain in normalizer and extractor 501 and gain quantizer 506. Prototype waveforms may be coded more efficiently if they are first normalized. The relationship between normalized and unnormalized prototype waveforms is expressed in terms of a gain. Once a normalized prototype is determined, the gain is quantized. The quantized gain is communicated over the channel for use in synthesizing a prototype waveform at the receiver. The gain is defined to mean the signal-power. Generally, the term signal-power is implicitly meant to describe the power per sample averaged over exactly one pitch cycle. However, in coders where the signal is not described in terms of pitch cycles, such as CELP, this quantity is difficult to evaluate. Often the signal-power is simply averaged over a sufficiently long window such that the effect of noninteger pitch cycles is small. Such a procedure lowers the time resolution. In the waveform-interpolation paradigm, the energy of the prototype waveforms is readily computed, and this provides a proper signal-power contour with the highest possible resolution.

Figure 15:
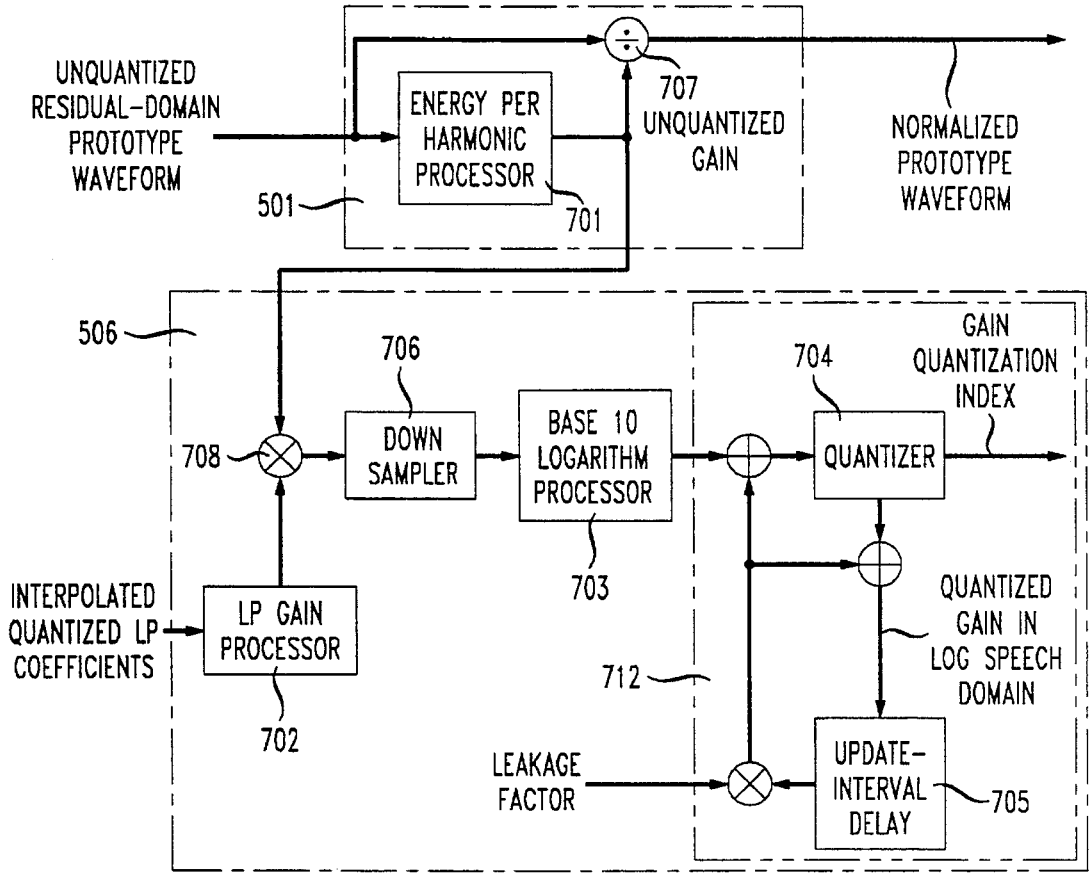
FIG. 15 presents a gain normalizer and quantizer of the prototype waveform quantizer of FIG. 13.

An overview of the gain extraction and quantization, and waveform normalization is shown in FIG. 15. First the root-mean-square (rms) energy per harmonic is computed for the prototype waveform (here assumed to be in the LP residual domain) in processor 701. To obtain a reliable estimate of the rms energy per harmonic, a subset of harmonics between 200 and 1300 Hz is used. The unquantized prototype waveform is divided by this number at circuit 707 to give the (gain-) normalized prototype waveform. These two operations fall within extractor 501 of FIG. 13.

FIG. 15 further presents the processing performed by gain quantizer 506 of FIG. 13. The LP gain is computed in LP gain processor 702. The rms energy computed in 701 is multiplied by the LP gain in multiplier 708. Using the speech domain means that channel errors in the LP coefficients cannot affect the reconstructed signal power. Thus, if the quantized energy is received without errors, the energy contour of the signal will be correct.

In down-sampler 706, the adjusted gain is down-sampled. Down-sampling to a rate of one gain per 10 ms provides good performance. The base 10 logarithm is then taken in processor 703. The logarithm of the signal power is perceptually more relevant than the linear signal power.

Down-sampler 706 is used because the required bandwidth for the gain is generally lower than the extraction frequency of the prototype waveforms. In principle, an anti-aliasing filter should be used prior to the down-sampling. However, in this application the anti-aliasing filter does not affect the perceived performance significantly. On the contrary, including the anti-aliasing filter is disadvantageous, because it introduces coder delay. Note that if an anti-aliasing filter is used, processor 703 can be placed prior to processor 706, so that the anti-aliasing filter can be used on the log of the speech energy, which is perceptually more significantly than the linear energy measure (which is the output of multiplier 708).

The actual quantization of the log of signal power in the speech domain is performed by a leaky differential quantizer 712. The leakage factor prevents indefinite channel-error propagation. Let $G(k\tau)$ be the gain in the log speech domain, at time $k\tau$ with $\tau$ the interval between the down-sampled gains, and let $\overline{G}(k\tau)$ be the quantized gain in the log speech domain, then quantizer 712 operates in accordance with expression (6):

$$\overline{G}(k\tau)=\alpha\overline{G}((k-1)\tau)+Q(G(k\tau)-\alpha\overline{G}((k-1)\tau)), \tag{6}$$

where $\alpha<1$ is the leakage (forgetting) factor, and Q (.) maps its argument to the nearest entry in a gain quantization table. The quantization operation Q(.) is conventional and is performed by quantizer 704, and a delay operation of $\tau$ is performed by delay unit 705.

Inner Layer: Computation of SEW and REW

After the normalization and quantization of their gain, the prototype waveforms are decomposed into a smoothly evolving component, which will be called the smoothly evolving waveform (SEW), and a rapidly evolving component, which will be called the rapidly evolving waveform (REW). For periodic signals (e.g. voiced speech) the SEW dominates, while for noisy signals (e.g. unvoiced speech) the REW dominates.

Referring again to FIG. 13, the SEW is formed by a smoothing operation performed in waveform smoother 502. The complex Fourier coefficients of the Fourier-series description of the prototype waveform will be denoted as c(kT,h) where kT is the time of extraction for the prototype waveform, T is the update interval, and h is the index of the harmonic. Waveform smoother 502 generates smoothed coefficients using a window w(m) in accordance with expression (7):

$$\bar{c}(kT,h)=\sum_{m=-nT}^{m=nT} w(m)c((k+m)T,h). \tag{7}$$

The window w(m) used by smoother 502 is, for example, a Hamming or Hanning window (or another linear-phase low-pass filter) normalized, such that the coefficients add to unity. Illustratively, n=7 at an update interval of 2.5 ms. Other methods of smoothing the prototype waveform can also be used. In the case of normalized prototype waveforms of the present embodiment, the window w(.) has to be weighted by the root-mean-square (rms) energy per harmonic (the unquantized gain) as obtained by gain extractor 501. That is, if v(m) is a smoothing window coefficient, then the weighting used is $w(m)=\beta v(m)G(m)$, where G(m) is the rms energy per harmonic of the prototype waveform extracted at (k+m)T, and $\beta$ is a factor which is used to insure that the sum of the windowing coefficients is unity:

$$\sum_{m=-nT}^{m=nt} w(m)=1.$$

Thus, the SEW is described by the set of coefficients $\bar{c}(kT,h)$. If the REW is described by the coefficients $\hat{c}(kT,h)$, then $$\hat{c}(kT,h)=c(kT,h)-\bar{c}(kT,h), \tag{8}$$

which is shown as subtraction 509 in FIG. 13.

In the above discussion, the prototype waveform was decomposed into a smoothly-evolving waveform, the SEW, and a rapidly evolving waveform, the REW. The SEW evolution may have a bandwidth of, for example, 20 Hz, and the REW evolution may have a frequency range of 20 Hz to l/p, where p is the pitch period. (Note that the roll-off of the smoothing filter is rather mild.) To maintain high time-resolution for the REW, which is highly desirable for the reconstruction of crisp onsets, a large evolution bandwidth for the REW is required, making a further decomposition of the REW less useful. The high time-resolution of the REW is clearly shown in FIG. 8. Nevertheless, the SEW-REW decomposition can be generalized to include not just two, but an arbitrary number of waveforms, each with an evolution which corresponds to a certain frequency band, and this may be useful for particular coding configurations.

Inner Layer: REW Quantization

The magnitude spectrum of the REW is computed in conventional fashion by processor 504. In an information-theoretic sense, the REW comprises most of the information contained in the sequence of prototype waveforms. However, most of this information is not perceptually relevant. In fact, it is possible to replace the phase spectrum of the REW by a random phase spectrum with virtually no change in perceptual quality. Furthermore, the REW magnitude-spectrum can be smoothed significantly without increasing the distortion. For example, a square window with a width of approximately 1000 Hz can be used for this smoothing. Finally, the magnitude spectrum of the REW can be averaged over all prototype waveforms extracted within a 5 ms interval with very little distortion. Thus, before quantization, the phase spectrum of the REW is discarded in processor 504.

Because the prototype waveforms are normalized, the shape of the REW magnitude spectrum is directly quantized by quantizer 505 as one of a small set of shapes. The normalization is exploited by using a shape quantizer as opposed to a gain-shape quantizer. A time resolution of 5 ms generally suffices for the REW magnitude spectrum. At a prototype extraction rate of 2.5 ms, this implies that the REW magnitude spectrum changes every second REW. The quantized magnitude spectrum of the REW is obtained simultaneously for the two REW. The magnitude spectrum of the REW can be smoothed in frequency prior to quantization. Division of the REW magnitude spectrum on the original prototype magnitude spectrum results in a frequency-dependent-periodicity-levels. This output can be used as a frequency-dependent-periodicity-level detector.

To quantize the REW, the shape of the quantized REW magnitude spectrum must be fit to vectors which vary in dimensionality with the pitch period of the signal. Shapes for a codebook can be specified in terms of a set of N analytic functions $z_i(x)$, i=1 . . . N. The shapes are specified over the interval [0,1] of x and also range in magnitude between 0 and 1. A reasonable set of shapes contains $z_i(x)=0.1$, $z_i(x)=0.9$, and several monotonically increasing functions. If H is the number of harmonics, and Z(h) is the REW magnitude spectrum of harmonic h then the shape index $i_{opt}$ is selected with $$i_{opt} = \underset{i}{argmin}\ [z_i(h/H) - Z(h)]^2. \tag{9}$$

A set of 8 shapes, i.e. 8 analytic functions, requiring 3 bits suffices to quantize the voicing level function Z(h) in a perceptually satisfactory manner. This is the entire bit allocation required for the REW.

To obtain better performance, the REW magnitude-spectrum quantization can employ spectral weighting, for example in a similar manner to that conventionally used to quantize the residual signal in CELP or prototype waveforms in earlier waveform-interpolation coders. In practice, this implies weighting the above error optimization with a diagonal matrix representing a speech-spectral envelope modified to be perceptual appropriate. To compute the perceptual weighting matrix, interpolated LP coefficients are required.

Inner Layer: SEW Quantization

Since the average magnitude spectrum of the prototype waveform is normalized (the average is taken to mean the average over the above discussed subset of harmonics), the average magnitude of the REW and the average magnitude of the SEW are not independent. Generally, because of the normalization of the pitch-cycle waveform, the average squared magnitude (power) spectrum the SEW approximates unity minus the average power spectrum of the REW. If no information is transmitted concerning the SEW, then the SEW power spectrum is obtained by the receiver as unity minus the REW power spectrum, or, less accurately, the SEW magnitude spectrum is obtained as unity minus the REW magnitude spectrum. Taking the square root of the average of the power spectrum of the SEW gives an appropriate gain for a shape quantizer of the complex or magnitude spectrum of the SEW. Shape codebooks for either the SEW magnitude or complex spectrum can be trained using a representative data base of SEW magnitude or complex spectra which are normalized by this gain (i.e. the magnitude of each harmonic is divided by this gain).

It will be appreciated by those of ordinary skill in the art that, because of the dependence of the average magnitudes of the REW and SEW, an embodiment of the present invention may be provided which communicates SEW (and not REW) information. In this case, the REW power spectrum may be obtained as unity minus the SEW power spectrum. However, such an embodiment sacrifices time resolution of the REW and is therefore not the preferred embodiment.

The SEW quantizer 503 can operate at various levels of accuracy. It is SEW quantization which mostly determines the bit rate of the speech coding system discussed here. As was mentioned above, for the lowest bit-rate coders, no transmission of SEW information is needed. As a result, speech is coded using only REW information and quantizer 503 does not operate.

At lower bit rates, either no information is transmitted concerning the SEW, or only its magnitude spectrum is quantized. In this case, the magnitude spectrum and phase spectrum of the SEW are treated separately, and the SEW phase spectrum description can be switched between several sets of phase spectra. This switching can be done in a manner which requires no additional transmission of information. Instead, the switching can be based on the REW magnitude spectrum (i.e. frequency-dependent voicing-levels). During voiced speech, a phase spectrum derived from an original pitch-cycle waveform (preferably from a male with a large number of harmonics, i.e. a low fundamental frequency) can be used. Such a phase spectrum tends to result in distinct pitch pulses, resulting in proper alignment of the reconstructed prototype waveforms. During unvoiced signals, a random phase can be used, which does not result in large time-domain features, such as high pulses. However, it is advantageous to choose these spectra such that any time-domain features (large in the case of the voiced phase spectrum) are pre-aligned, so that no clear phase discontinuities appear during switches between these phases.

It is possible to use a sequence of phase spectra for the SEW, characterized with an index ranging from O through K. Whenever the REW information indicates that the signal is periodic, the index is increased, and whenever the REW information indicates that the signal is nonperiodic, the index is decreased. Thus, the SEW varies from "peaky" to "smeared out" as a function of the index. Alternatively, the peakiness can be measured in the original SEW (e.g. by measuring the relative signal energy in regions of high and low signal power within a pitch cycle). In this case, a peakiness index must be transmitted.

It should be noted that a fixed or switched phase spectrum require a highly accurate pitch detector. If the pitch detector renders, for example, a pitch period which is doubled the correct value during a segment voiced speech, then the extracted (original) prototype waveform will contain two pitch cycles. This means that there will be two pitch pulses in the prototype waveform. Thus, the basic analysis-synthesis system of the outer layer 101 will still provide excellent reconstructed speech quality. However, if the phase information is discarded in the quantization of the SEW, then only a single pitch pulse will be present in the reconstructed waveform, and the reconstructed speech will sound significantly different from the original. Such distortions often sound natural, however, because they simulate naturally occurring conditions.

For improved speech quality, the magnitude spectrum of the SEW can be quantized. This can be done with conventional vector—or differential vector quantization. As stated above, if the REW magnitude spectrum is known and the prototype waveforms are normalized, then the default value of the SEW magnitude spectrum has as components the square-root of unity minus the REW power spectrum components. Just using unity minus the REW magnitude spectrum also provides good performance.

Similarly to the frequency-dependent periodicity-level, quantization of the magnitude spectrum shape must be done independently of the dimensionality of the vector describing the magnitude spectrum. Again, a set of analytic functions can be used for this purpose, e.g. a set of polynomials. Because the magnitude spectrum of the SEW evolves slowly, it is advantageous to use differential quantization with leakage. If this quantization operates directly on the magnitude spectrum, leakage should occur towards the default magnitude spectrum to make the coder robust against channel errors. Let S(kT) be the unquantized magnitude spectrum at time kT, $\bar{S}$(kT) the quantized spectrum, and F the default spectrum. Then the magnitude shape can be quantized according to the following expression:

$$\bar{S}(kT)=F+\alpha(\bar{S}((k-1)T)-F)+Q((S(kT)-F)-\alpha(\bar{S}((k-1)T)-F)), \quad (10)$$

where α is the leakage factor and Q(.) is the quantization of the differential shapes. This quantization can be performed both in the linear or the log magnitude spectrum. The spectrum F can be and a zero vector in the case of the log spectrum.

Good performance can be obtained if the entire complex spectrum of the SEW is quantized without separation into magnitude and place spectra. Since voiced speech segments are peaky, whereas unvoiced segments are not, such an approach matches well the differences in the nature of voiced and unvoiced speech sounds. Because of the normalization of the prototype waveform, it is possible to use a conventional (shape) vector quantizer instead of gain-shape quantizer. However, at higher bit rates, where the codebook becomes too large for exhaustive searching, a gain-shape quantizer may be useful. Equation (10) for differential quantization of a shape can also be used for quantization of the complex spectrum, where F can be set to zero. In this case it is reasonable to have a codebook which contains complex vectors of a dimension larger than the largest number of harmonics, and select from that codebook only the components required. Such a codebook implies that the time-domain shape scales with the pitch period.

The previous quantization methods for the SEW can operate on each unquantized SEW, or they can operate on a down-sampled sequence of SEWs. Since the SEWs are inherently band limited, no anti-aliasing filter is required. During dequantization of the SEW, interpolation must be used to generate the "missing" SEWs. Simple linear interpolation can be used for this purpose.

To enhance the performance of the vector quantizer, multiple-stage codebooks may be used. In general the codebooks used for the various stages are not identical. Such multiple-stage codebooks can be used to quantize a down-sampled sequence of SEWs. However, one can also increases the sampling rate (i.e. make the down sampling less severe), and quantize more often. Note that to maintain approximately the performance obtained by two-stage searching, a vector quantizer running at twice the sampling rate must have two alternating codebooks. In other words, codebook A is used for quantization at sample times t, 3t, 5t, . . . (where t is the sampling time), while codebook B is used for quantization at sample times 0t, 2t, 4t, 6t, . . . . Such alternating codebooks will result in higher performance than using a single codebook at all sampling points. The performance can be further increased by generalizing this principle to rotating through a set of codebooks.

Note that the signal power is much higher in voiced speech segments and that this signal power is considered in the weights w(m) to compute the SEW in equation (3). This is a desirable property, because the shape of the SEW during the voiced speech is anticipated prior to the voiced region. As a result, the shape quantizers for the SEW, which usually operate in a differential fashion, can converge to the correct shape of the SEW before the voiced segment occurs. Such a mechanism contrasts with e.g. CELP where voicing onsets cannot be anticipated, and where the waveform matching is often highly inaccurate just after the voicing onset. However the anticipation of a voiced segment also increases the energy of the SEW somewhat as compared to the prototype-waveform energy. This effect does not effect performance significantly, because of the final renormalization. However, available distortion can be removed by renormalizing the SEW prior to its quantization such that the average energy of the SEW cannot exceed that of the prototype waveform.

The decomposition of each prototype waveform into an SEW and REW allows the embedding of lower bit rate coders within a higher rate coder. Embedded coders are useful if the capacity of the communication system is sometimes exceeded and for conferencing systems. In an example of an embedded coder at 8 kb/s, the bit stream can be separated into a bit stream which represents a 4 kb/s coder and a second 4 kb/s bit stream which provides an enhancement of the reconstructed speech quality. When external situations demand this, the latter bit stream is removed, rendering a 4 kb/s coder at to the receiver. Note that the 4 kb/s coder can itself also be an embedded coder. In the present waveform-interpolation method, transmission of the pitch track, the linear-prediction coefficients, the signal power, and the REW (at a 10 ms update rate) are essential for a basic speech coder. Such a system requires approximately 2–3 kb/s. An increase in the update rate of the REW and a description of the magnitude spectrum or the complex spectrum of the SEW can be used to enhance the reconstructed speech quality. To provide multiple levels of embedding, the description of the SEW can be divided into a sum of various encodings.

Inner Layer: Prototype-Waveform Reconstructor

Figure 14:
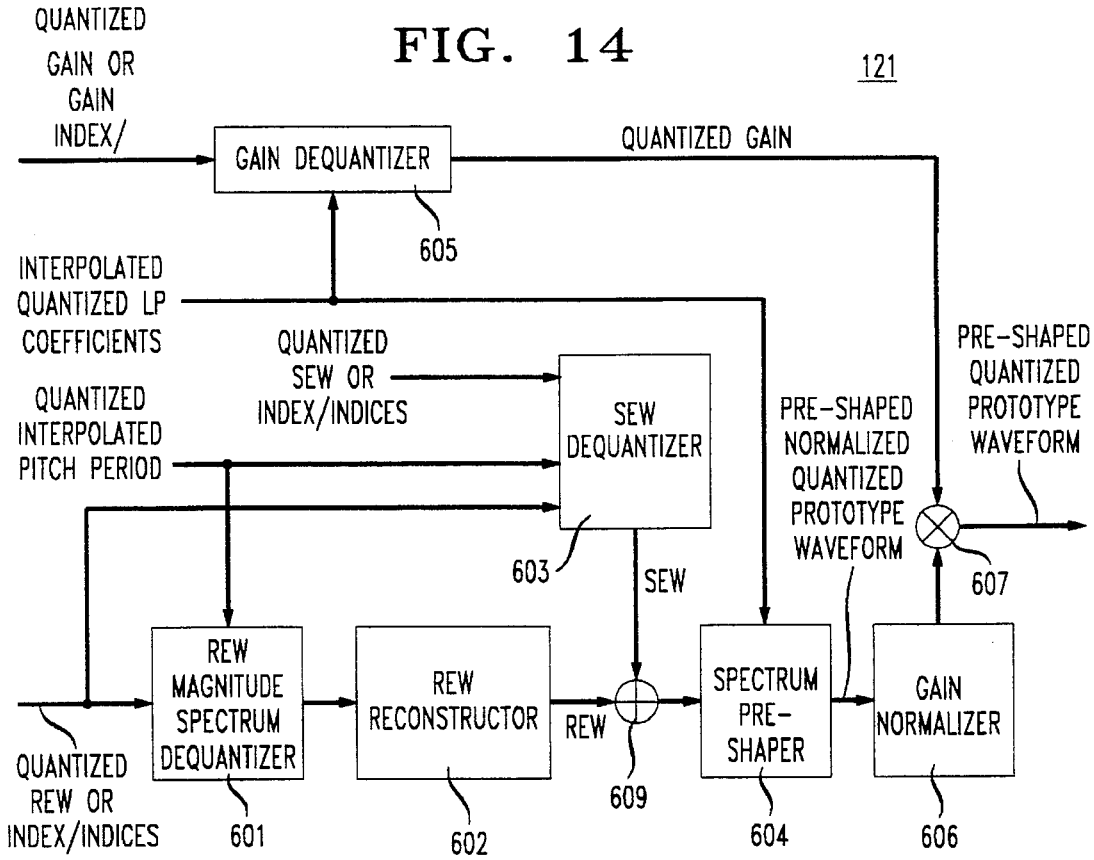
FIG. 14 presents a prototype waveform reconstructor of the inner layer shown in FIG. 9.

FIG. 14 shows the prototype-waveform reconstructor at the receiver. In processor 601, the quantized REW magnitude spectrum is determined from the transmitted quantization indices and the quantized, interpolated pitch period. The local pitch period is required to determine the number of harmonics H of the magnitude spectrum. The description of the analytic function $z_i()$ is retrieved from a table, using the transmitted index i, and the value of the function $z_i(h/H)$ is then computed for each of the harmonics h.

In REW-reconstructor 602, a Fourier-series description of the REW is obtained. In 602, first a random phase spectrum (different at each update) is computed using a random-number generator or a table-lookup procedure. The magnitude spectrum and the random phase spectrum together form a complex spectrum in polar coordinates. Converting the radial coordinates to Cartesian coordinates provides the Fourier-series coefficients.

Using a random phase spectrum in combination with a deterministic magnitude spectrum results in relatively "harsh" sounding noise contributions in the reconstructed speech. While this is satisfactory for most purposes, "smoother" sounding noise contributions can be obtained by generating the REW using sets of Fourier-series coefficients which represent time-domain Gaussian-noise sample sequences of length one pitch cycle. These complex Fourier-series are multiplied by the REW magnitude spectrum to obtain a good REW.

The reconstructed speech quality can be further enhanced by additional processing within REW reconstructor 602.

When the periodicity level is small for low frequencies, and higher for high frequencies such enhancement can be obtained with amplitude modulation of the REW. It is known from studies of the vocal cords, that so-called aspiration noise is not uniformly distributed over the pitch cycle, but mostly located near the pitch pulse. This knowledge can be exploited in the reconstruction of the prototype waveforms by modulating the REW amplitude using the SEW amplitude-envelope. Alternatively, information about the amplitude envelope of the REW can be transmitted.

In SEW dequantizer 603, the quantized SEW waveform is obtained from the quantization indices (if the quantized values are provided then the dequantizer performs no function). If differential quantizers are used then equation (6) can again be used, where now the term Q(.) represents a table look-up using the transmitted index. In order to obtain a SEW with the correct number of harmonics the quantized, interpolated pitch period is required. If no information is transmitted about the SEW, then the SEW is obtained from the description of the REW. As explained before, in this case, the SEW power spectrum is obtained as the unity spectrum minus the REW power (magnitude squared) spectrum, or, less accurately, the SEW magnitude spectrum is obtained as unity minus the REW magnitude spectrum.

The SEW and the REW are added in adder 609. Since the Fourier-series is a linear transformation of the time-domain waveform, this addition can be accomplished by addition of the Fourier-series coefficients (or, equivalently the complex Fourier spectrum). The output of adder 609 is a normalized, quantized prototype waveform.

In spectrum pre-shaper 604, the normalized, quantized prototype waveform is provided with spectral pre-shaping to enhance the final speech quality. The purpose of this spectral pre-shaping is identical to that of the postfilter as used for example in CELP algorithms. Thus, the pre-shaper is equivalent to filtering the prototype waveform with an all-pole and an all-zero filter in cascade. The all-pole filter has its poles at the same frequencies as the poles of the all-pole linear-prediction (LP) filter, but its poles have radius smaller by a factor $\gamma_p$. The zeros of the all-zero filter have the same frequency as the poles of the all-pole filter, but the zeros have a radius smaller by a factor $\gamma_z/\gamma_p$. To add this formant structure, the waveform may be processed in accordance with expressions (18) and (19) in: W. B. Kleijn, "Encoding Speech Using Prototype Waveforms" *IEEE Trans. Speech and Audio Processing,* Vol. 1, p. 386–399, 1993. A good formant structure for the pre-shaped prototype waveform is obtained by using $\gamma_p$=0.9, and $\gamma_z$=0.8. This pre-shaping enhances the spectral peaks of the reconstructed speech signal. Alternatively, the pre-shaping can be performed by computing the magnitude spectrum of the transfer function of the cascade of the all-zero and all-pole pre-shaping filters, and then multiplying the complex spectrum of the normalized, quantized prototype waveform by this magnitude spectrum. Note that in contrast to conventional postfiltering, the pre-shaping does not affect coder delay.

The pre-shaped spectrum will, in general, not have a unit gain. Gain normalizer 606 renormalizes the gain prior to the multiplication of the normalized prototype waveform by the quantized gain in multiplier 607. Gain normalizer 606 performs the same operations as gain extractor and normalizer 501.

Inner Layer: Gain Dequantizer

Figure 16:
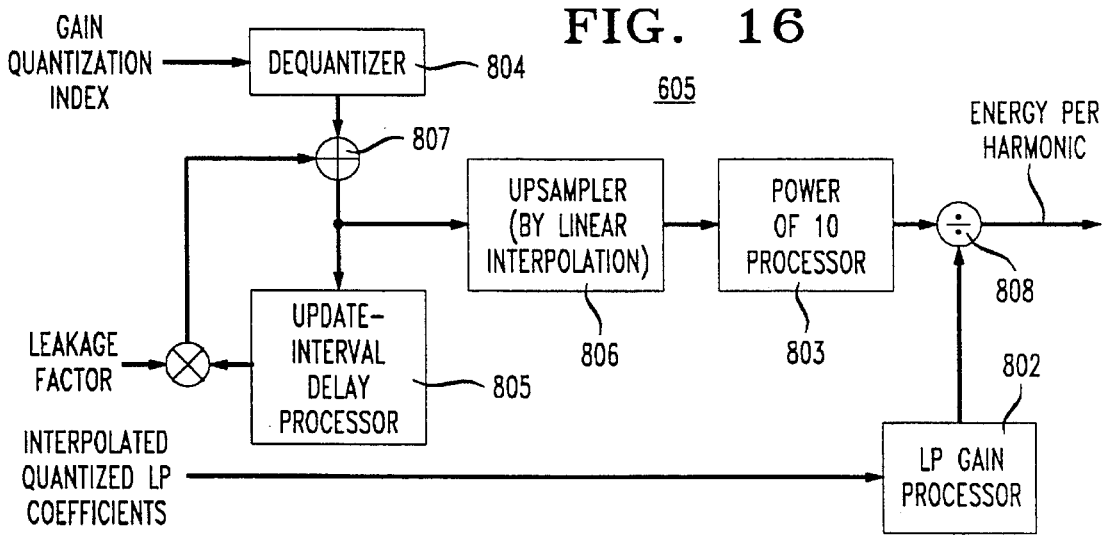
FIG. 16 presents a gain dequantizer of the prototype waveform reconstructor of FIG. 14.

Gain dequantizer 605 of the receiver is shown in more detail in FIG. 16. Dequantizer 804 looks up a quantized scalar using the received index. The previous quantized gain in the log speech domain is stored in delay unit 805 and then multiplied by the leakage factor $\alpha$. The quantized scalar output of 804 is added to this scaled previous quantized gain value in adder 807. The output of adder 807 is the quantized gain in the log speech domain. This gain is upsampled in 806 by use of linear interpolation. (Interpolation of the log speech-domain gain, provides a better match to the original energy contour than linear interpolation of the speech-domain gain.) The output of 806 is a quantized log speech-domain gain for each transmitted prototype. In 803, the quantized log speech-domain gain is convened to the quantized speech-domain gain.

In 802 (which is identical to 702), the LP gain is computed from the quantized interpolated LP coefficients. The quantized speech-domain gain (output of 803) is then divided by the LP gain in divider 808. The output of divider 808 is the rms energy of the prototype waveform per harmonic. Multiplication of the normalized, quantized prototype waveform by the rms energy per harmonic gives the properly scaled quantized prototype waveform (this scaling is performed in multiplication 607 of FIG. 6).

Although a number of specific embodiments of this invention have been shown and described herein, it is to be understood that these embodiments are merely illustrative of the many possible specific arrangements which can be devised in application of the principles of the invention. Numerous and varied other arrangements can be devised in accordance with these principles by those of ordinary skill in the art without departing from the spirit and scope of the invention.

- outer layer inner layer structure (periodicity levels in inner layer)
- determination of REW by subtraction of SEW from prototype waveform
- fixed-rate of extraction in combination with REW and SEW
- separate manipulation of the magnitude and phase spectrum of the REW
- voicing detector which is ratio of REW and prototype waveform magnitude spectra
- throw away phase spectrum of REW
- separate manipulation of the magnitude and phase spectrum of the SEW
- fixed extraction rate (not once per pitch cycle)
- gain quantization of the prototype waveform
- modulation of the REW
- variable rate coding based on SEW rate of change
- alignment where only part of range is searched, so as to get alignment during voiced, while not aligning during unvoiced
- quantized SEW phase independently, determine SEW phase states from voicing decision, or peakiness measure.
- measure peakiness of SEW or prototype waveform, reconstruct SEW appropriately
- usage of polynomial or other analytic function for shape of voicing levels.
- alternating codebooks.
- performing operations on normalized prototype waveforms

PREFILTER ON PROTOTYPES TO BOOST SPECTRUM

We claim:

1. A method of coding a speech signal, the method comprising the steps of:

1. generating a time-ordered sequence of sets of parameters based on samples of the speech signal, each set of parameters corresponding to a waveform characterizing the speech signal;
2. grouping parameters of the plurality of sets based on index values for said parameters to form a first set of signals which set represents an evolution of characterizing waveform shape across the time-ordered sequence of sets;
3. filtering signals of the first set to remove low-frequency components of said signals evolving over time at low frequencies, wherein said filtering produces a second set of signals which second set represents relatively high rates of evolution of characterizing waveform shape; and
4. coding said speech signal based on the second set of signals.

2. The method of claim 1 wherein the second set of signals comprises a plurality of second characterizing waveforms and wherein a magnitude spectrum of a second characterizing waveform is used in coding said speech signal.

3. The method of claim 2 wherein an average of magnitude spectra of a plurality of second characterizing waveforms is used in coding said speech signal.

4. The method of claim 2 wherein a phase spectrum of a second characterizing waveform is used in coding said speech signal.

5. The method of claim 1 wherein the step of filtering comprises the steps of:

a. smoothing the signals of the first set to form a set of smoothed first signals, wherein the set of smoothed first signals associated with a discrete time comprises a third characterizing waveform; and b. associated with a plurality of discrete times, forming a difference between a third characterizing waveform and the waveform characterizing the speech signal.

6. The method of claim 5 wherein the step of smoothing comprises forming a weighted average of values of a signal of said first set.

7. The method of claim 6 wherein the values of a signal of the first set represent Fourier series parameter values of characterizing waveforms.

8. The method of claim 6 wherein the values of a signal of the first set represent time-domain samples of characterizing waveforms.

9. The method of claim 1 wherein the step of coding comprises determining parameters corresponding to a second characterizing waveform based on the second set of signals and coding said speech signal based on said determined values.

10. The method of claim 1 wherein said indexed parameters comprise Fourier series coefficients.

11. The method of claim 10 wherein the step of grouping parameters comprises selecting Fourier coefficients of like-index value.

12. The method of claim 1 wherein said parameters comprise time-domain signal samples.

13. The method of claim 12 wherein the step of grouping parameters comprises selecting time-domain signal samples of like-index value.

14. The method of claim 1 wherein the waveform characterizing the speech signal is substantially one pitch-period in length.

15. The method of claim 1 wherein the step of coding said speech signals is further based on a set of smoothed first signals.

16. The method of claim 15 wherein the step of coding the speech signal comprises forming at least two bit streams, wherein a first bit stream represents said second set of signals and a second bit stream represents said smoothed first signals.

17. The method of claim 15 wherein the set of smoothed first signals are evaluated at at least two discrete times to determine at least two third characterizing waveforms, and wherein the step of coding comprises representing said at least two third characterizing waveforms with distinct codebooks.

18. The method of claim 1 wherein the step of coding comprises performing embedded coding.

19. A method of coding a speech signal, the method comprising the steps of:

1. generating a time-ordered sequence of sets of parameters based on samples of a speech signal, each set of parameters corresponding to a waveform characterizing the speech signal;
2. grouping parameters of the plurality of sets based on index values for said parameters to form a first set of signals which set represents an evolution of characterizing waveform shape across the time-ordered sequence of sets;
3. filtering signals of the first set to remove components of said signals evolving over time at high frequencies, wherein said filtering produces a second set of signals which second set represents relatively low rates of evolution of characterizing waveform shape; and
4. coding said speech signal based on the second set of signals.

20. A method of coding a speech signal using a set of fixed codebooks, the speech signal comprising sequential sets of samples of said speech signal, each set of samples specifying the value of said signals at a specific point in time, the method comprising the steps of:

coding a first set of samples of the speech signal with a first codebook; and coding a different time-successive set of samples of the speech signal with a codebook other than said first codebook.

* * * * *